US010577147B2

(12) United States Patent
Fu

(10) Patent No.: US 10,577,147 B2
(45) Date of Patent: Mar. 3, 2020

(54) COLLAPSIBLE STORAGE BOX STRUCTURE

(71) Applicant: BESTMATE INTERNATIONAL DEVELOPING CO., LTD., Yilan County (TW)

(72) Inventor: Kuang-Huan Fu, Yilan County (TW)

(73) Assignee: BESTMATE INTERNATIONAL DEVELOPING CO., LTD., Yilan County (TW)

( * ) Notice: Subject to any disclaimer, the term of this patent is extended or adjusted under 35 U.S.C. 154(b) by 87 days.

(21) Appl. No.: 15/928,068

(22) Filed: Mar. 21, 2018

(65) Prior Publication Data

US 2019/0291921 A1 Sep. 26, 2019

(51) Int. Cl.
*B65D 6/24* (2006.01)

(52) U.S. Cl.
CPC ..... *B65D 11/1893* (2013.01)

(58) Field of Classification Search
CPC ... A45C 7/0063; A45C 7/0077; B65D 11/186; B65D 11/1893; B65D 37/00; B65D 21/086; B65D 33/02; A47B 43/04
USPC ..... 383/119, 121.1; 220/6, 9.2
See application file for complete search history.

(56) References Cited

U.S. PATENT DOCUMENTS 7,635,064 B2 * 12/2009 Wang ..... B65D 37/00 220/4.28
2006/0163249 A1 * 7/2006 Fu ..... B65D 37/00 220/9.4

* cited by examiner

*Primary Examiner* — Andrew T Kirsch
(74) *Attorney, Agent, or Firm* — Leong C. Lei

(57) ABSTRACT

A collapsible storage box structure includes a soft cloth box body and bottom plate, the opening of the box body provided with a frame, and two sides of the box body are respectively covered with a hard side plate; the bottom plate is made of hard material covered with soft cloth, a center of a bottom face of the soft cloth is in connection with a bottom of the box body in a straight line shape, upon use, the bottom plate is pressed downward to hold the storage box open, and while not in use, the bottom plate is pulled upward to allow the two side plates to be folded in a central portion of the storage box, and the two side plates and bottom plate are then folded and stacked together to form a flat body, thereby facilitating carrying and collecting.

4 Claims, 4 Drawing Sheets

COLLAPSIBLE STORAGE BOX STRUCTURE

(A) TECHNICAL FIELD OF THE INVENTION

The present invention relates to a collapsible storage box structure, and more particularly to a collapsible storage box structure, formed into a storage box simply by pressing downward and pulling upward it upon use, and capable of being folded into a flat body so as to be facilitating carrying and collecting while not in use.

(B) DESCRIPTION OF THE PRIOR ART

General storage boxes for the accommodation of various articles are usually configured with a basic frame made of wood or plastics, inside which a plurality of partition plates are configured so as to allowed articles to be placed in the accommodation areas formed by partition plates. Since conventional storage boxes are structurally fixed, they can be assembled on use, but the entire storage boxes cannot be folded while not in use, causing their volume to occupy too much space upon storage, not only being troublesome in transportation but inconvenient in collecting. Furthermore, if they are detached, it will be very time-consuming to reassemble them again upon use.

SUMMARY OF THE INVENTION

To allow a storage box to be used more conveniently, the present invention is proposed.

The main object of the present invention is to provide a collapsible storage box structure, using simple downward pressing to form a storage box upon use, and using simple upward pulling to fold and stack the storage box into a flat body while not in use, thereby facilitating carrying and collecting.

To achieve the object mentioned above, the present invention proposes a collapsible storage box structure, including a box body having an upper opening and a bottom plate in combination with the box body, wherein the box body is made of soft cloth, the opening of the box body surrounded with a fame, and two sides of the box body are respectively covered with a hard side plate; the bottom plate is made of hard material covered with soft cloth, a center of a bottom face of the soft cloth is in connection with a bottom of the box body in a straight line shape, upon use, the bottom plate is pressed downward to stay close to the bottom of the box body, and two lateral sides of the bottom plate are used to prop against lower edges of the two side plates, thereby being held open to be a storage box, and while not in use, the bottom plate is pulled upward to allow the two side plates to be folded inward a center of the storage box, and the two side plates and bottom plate are then folded and stacked together to form a flat body, thereby facilitating carrying and collecting.

According to the collapsible storage box structure mentioned above, upper, lower edges of the two hard side plates are respectively placed on the lower edge of the frame and two sides of the bottom plate, thereby facilitating propping against the bottom plate.

According to the collapsible storage box structure mentioned above, the frame is made of metal for the placement thereof on the opening of the box body, and sewn and fixed to the box body after covered with soft cloth.

According to the collapsible storage box structure mentioned above, the two side plates respectively are a hard paper plate or plastic plate; the two side plates are placed on two sides of the box body, and sewn and fixed to the box body after covered with soft cloth.

According to the collapsible storage box structure mentioned above, the bottom plate is made of hard material, and sewn and fixed to the box body after covered with soft cloth, and a center of a bottom face of the soft cloth is sewn and connected to the bottom of the box body in a straight line shape.

DETAILED DESCRIPTION OF THE PREFERRED EMBODIMENTS

Figure 1:
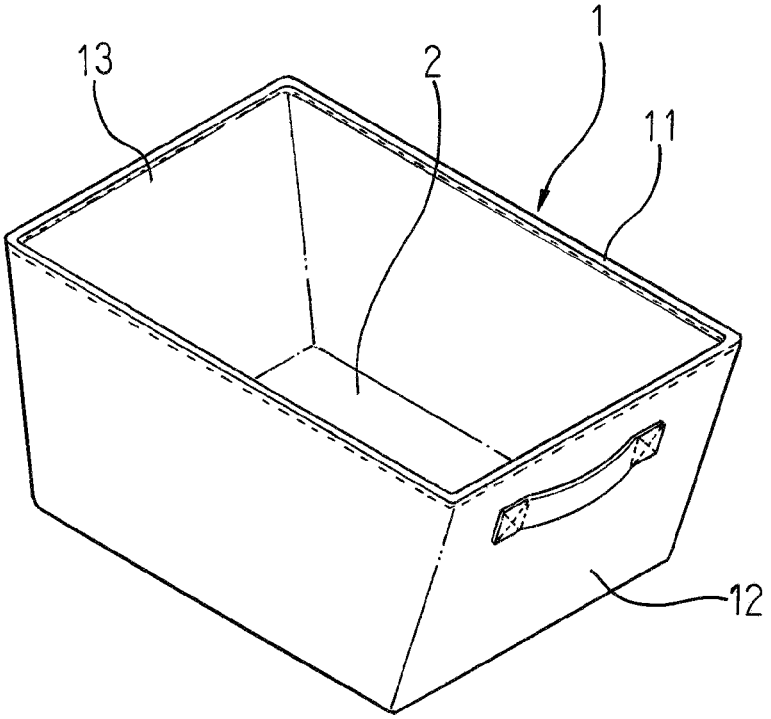
FIG. 1 is a perspective view of the present invention.
Figure 2:
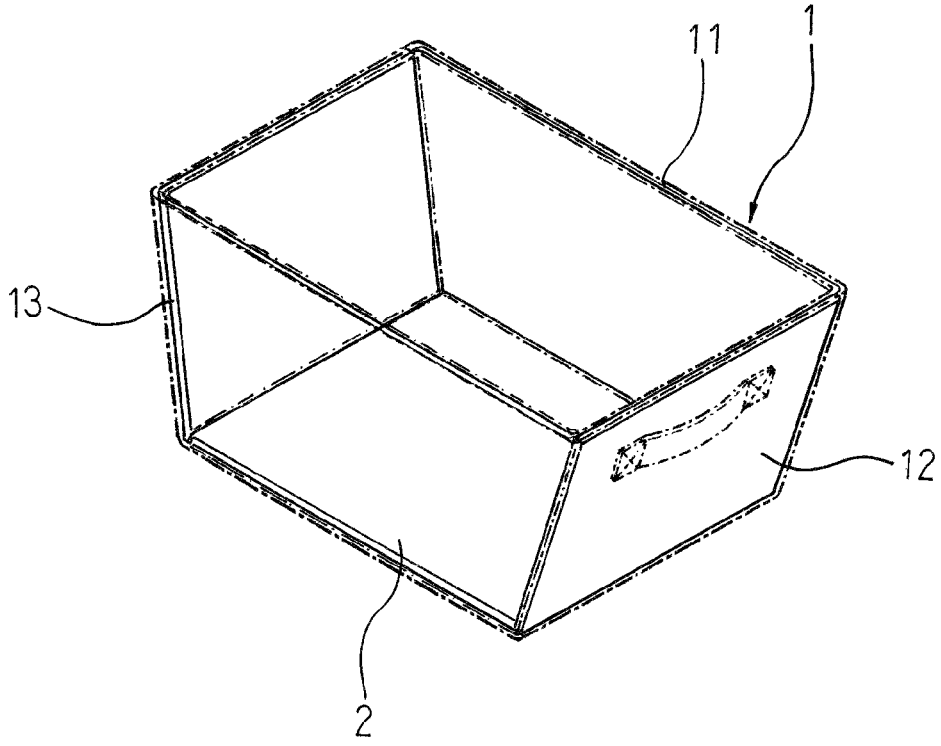
FIGS. 2 and 3 show the structure of the present invention.
Figure 3:
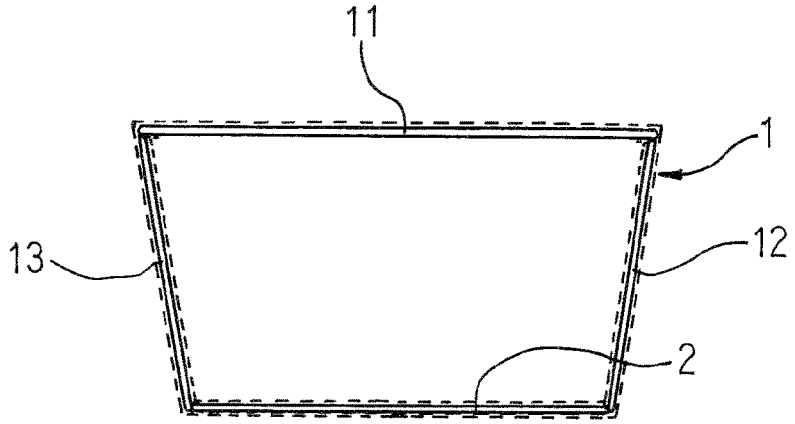

Referring to FIGS. 1 to 3, a collapsible storage box structure of the present invention includes a box body 1 having a upper opening and a bottom plate 2 in combination with the box body, where the box body 1 is made of soft cloth, and the opening of the box body 1 is surrounded with a frame 11. Furthermore, the two sides of the box body are respectively covered with a hard side plate 12, 13. In the embodiment, the frame 11 is made of metal and placed on the opening of the box body 1, covered with a soft cloth and then sewn and fixed to the box body 1 (sewn to the box body 1 after the edge of the soft cloth is covered on the frame 11). Furthermore, the two side plates 12 and 13 respectively are a hard paper plate or plastic plate; the two side plates 12, 13 are placed on the two sides of the box body 1, and then sewn and fixed to the box body 1 after a piece of soft cloth is covered on each of them.

The bottom plate 2 is made of a hard material covered with soft cloth, and the center of the bottom face thereof is in connection with the bottom of the box body 1 in a straight line shape. In the embodiment, the bottom plate 2 is made of a hard paper plate or plastic plate, and sewn and fixed to the box body 1 after covered entirely with a soft cloth. Thereafter, the center of the bottom face of the soft cloth is sewn and connected to the bottom of the box body 1 in a straight line shape.

With the combination of the above components, a collapsible storage box structure is formed. Upon use, the bottom plate 2 is pressed downward to make it stay close to the bottom of the box body 1, and the two lateral sides thereof are used to prop against the lower edges of the two side plates 12, 13. Thus, the entire structure is held open to form a storage box; and while not in use, the bottom plate 2 is pulled upward to make the two side plates 12, 13 to be folded inward the center thereof, and the two side plates 12, 13 and bottom plate 2 are then folded and stacked together to from a flat body so as to facilitate carrying and collecting.

Figure 4:
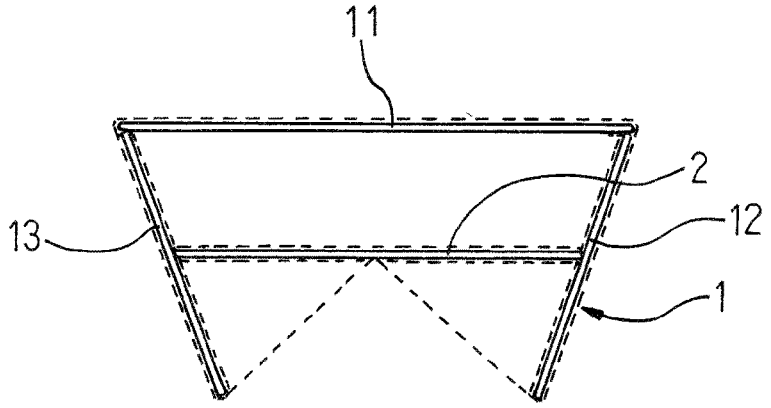
FIG. 4 is a schematic view of the present invention upon the folding thereof.

Referring to FIG. 4, the entire storage box of the present invention can be folded and stacked together while not in use; when folded to collect, the bottom plate 2 of the storage box is pulled upward, and the bottom of the box body 1 will also be pulled upward with the bottom plate 2, allowing the bottom edges of the side plates 12, 13 configured on the two sides of the box body 1 are relatively respectively pulled inward since the center of the bottom face of the bottom plate 2 is in connection with the bottom of the box body 1 in a straight line shape.

Figure 5:
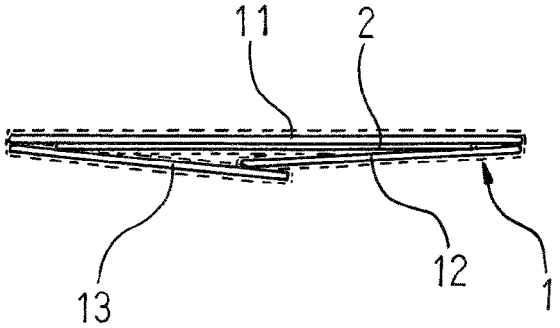
FIG. 5 is a schematic view of the present invention in a folding and stacking state.

Referring to FIG. 5, the bottom edges of the side plates 12, 13 configured on the two sides of the box body 1 are respectively pulled inward when the bottom plate 2 of the present invention is pulled upward, one of the side plates 12, 13, here, the side plate 12, will be stacked on the bottom edge of the bottom plate 2 after the bottom plate 2 is pulled up to a certain height and the other side plate 13 will then be stacked on the side plate 12, allowing the entire storage box to be folded and stacked into a flat-shaped body, thereby facilitating carrying, transportation and collecting.

Figure 6:
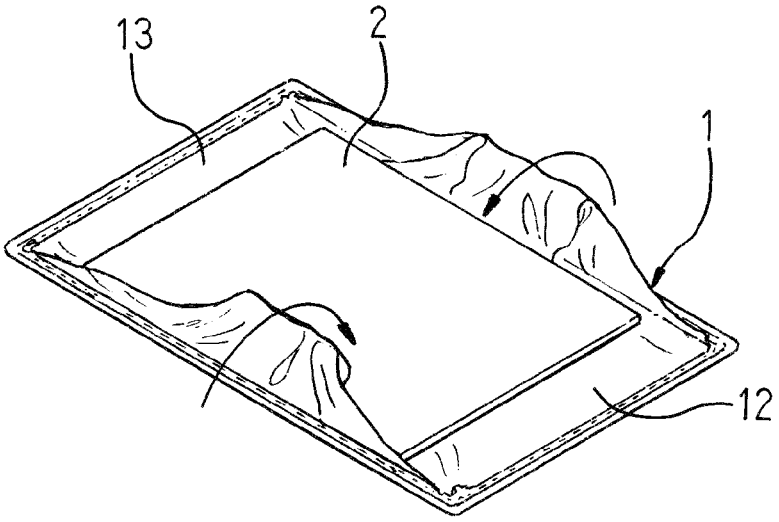
FIG. 6 is a perspective view of the present invention during folding.

Referring to FIGS. 4 to 6, the side plates 12, 13 are respectively caused to stacked on the upper side of the bottom plate 2 after the bottom plate 2 is pulled upward when the storage box of the present invention is folded up, and the longitudinal soft cloth pieces of the box body 1 will be compressed; the soft cloth pieces compressed out may be folded inward to keep the folded storage box in a flat shape.

Figure 7:
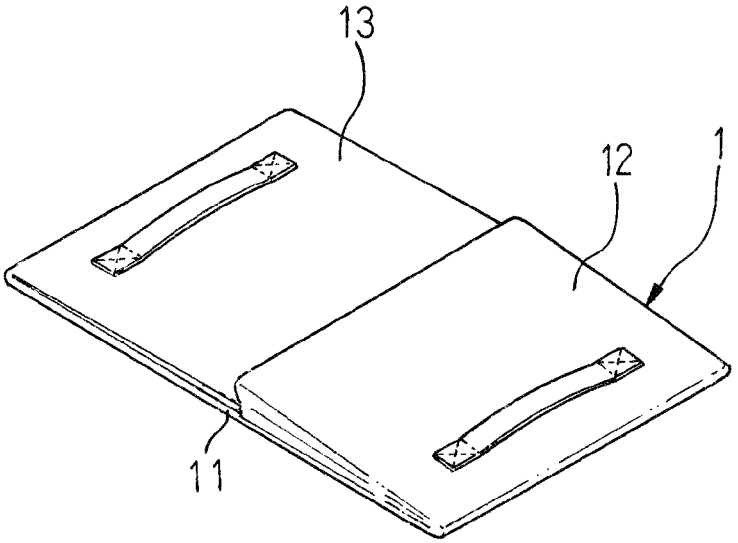
FIG. 7 is a perspective view of a folded and stacked storage box of the present invention.

Referring to FIG. 7, the two side plates 12, 13 are respectively stacked on the bottom plate 2 after the storage box of the present invention is folded up and stacked together, allowing the entire storage body to be formed into a flat body, facilitating collecting without occupying space and being convenient for carrying and transportation.

I claim:

1. A collapsible storage box structure, comprising a box body having an upper opening and a bottom plate in combination with said box body, wherein said box body is made of soft cloth, said opening of said box body provided with a frame, and two sides of said box body are respectively covered with a hard side plate; said bottom plate is made of hard material covered with soft cloth, a center of a bottom face of said soft cloth is in connection with a bottom of said box body in a straight line shape, upon use, said bottom plate is pressed downward to stay close to said bottom of said box body, and two lateral sides of said bottom plate are used to prop against lower edges of said two side plates, thereby being held open to be a storage box, and while not in use, said bottom plate is pulled upward to allow said two side plates to be folded in a central portion of said storage box, and said two side plates and bottom plate are then folded and stacked together to form a flat body, thereby facilitating carrying and collecting.

2. The structure according to claim 1, wherein said frame is made of metal for the placement thereof on said opening of said box body, and sewn and fixed to said box body after covered with soft cloth.

3. The structure according to claim 1, wherein said two side plates respectively are a hard paper plate or plastic plate; said two side plates are placed on two sides of said box body, and sewn and fixed to said box body after covered with soft cloth.

4. The structure according to claim 1, wherein said bottom plate is made of hard material, and sewn and fixed to said box body after covered with soft cloth, and a center of a bottom face of said soft cloth is sewn and connected to said bottom of said box body in a straight line shape.

* * * * *